US010467964B2

(12) United States Patent
Gupta et al.

(10) Patent No.: US 10,467,964 B2
(45) Date of Patent: Nov. 5, 2019

(54) DEVICE AND METHOD FOR EMISSION DRIVING OF A VARIABLE REFRESH RATE DISPLAY

(71) Applicant: Apple Inc., Cupertino, CA (US)

(72) Inventors: Vasudha Gupta, San Jose, CA (US); Chin-Wei Lin, Cupertino, CA (US); Yafei Bi, Palo Alto, CA (US); Hung Sheng Lin, San Jose, CA (US); Jean-Pierre Simon Guillou, San Francisco, CA (US); Tsung-Ting Tsai, Cupertino, CA (US); Sang Y. Youn, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 234 days.

(21) Appl. No.: 15/041,836

(22) Filed: Feb. 11, 2016

(65) Prior Publication Data

US 2017/0092196 A1 Mar. 30, 2017

Related U.S. Application Data

(60) Provisional application No. 62/234,211, filed on Sep. 29, 2015.

(51) Int. Cl.

| | |
|---|---|
| ***G09G 3/3258*** | (2016.01) |
| ***G09G 3/3233*** | (2016.01) |
| ***G09G 3/3266*** | (2016.01) |

(52) U.S. Cl.

CPC ..... *G09G 3/3258* (2013.01); *G09G 3/3233* (2013.01); *G09G 3/3266* (2013.01);

(Continued)

(58) Field of Classification Search

CPC .. G09G 3/3258; G09G 3/3266; G09G 3/3233; G09G 2330/023;

(Continued)

(56) References Cited

U.S. PATENT DOCUMENTS

| | | | |
|---|---|---|---|
| 5,185,602 | A | 2/1993 | Bassetti et al. |
| 7,286,108 | B2 | 10/2007 | Tsuda et al. |

(Continued)

FOREIGN PATENT DOCUMENTS

| | | | |
|---|---|---|---|
| CN | 1107233 | A | 8/1995 |
| CN | 1440514 | A | 9/2003 |

(Continued)

OTHER PUBLICATIONS

Umper for Chinese Patent No. ZL201620948342.0 dated Aug. 2, 2017; 8 pgs.

(Continued)

*Primary Examiner* — Temesghen Ghebretinsae
*Assistant Examiner* — Ivelisse Martinez Quiles
(74) *Attorney, Agent, or Firm* — Fletcher Yoder, P.C.

(57) ABSTRACT

An electronic device comprises a display and a controller. The controller is configured to determine a change in a refresh rate of the display from a first frequency to a second frequency. The controller is also configured to selectively generate a control signal configured to control emission of a light emitting diode of a display pixel of the display based on the first frequency.

21 Claims, 9 Drawing Sheets

(52) U.S. Cl.
CPC ..... *G09G 2300/0809* (2013.01); *G09G 2300/0842* (2013.01); *G09G 2300/0861* (2013.01); *G09G 2310/0251* (2013.01); *G09G 2320/0247* (2013.01); *G09G 2320/0252* (2013.01); *G09G 2330/023* (2013.01); *G09G 2340/0435* (2013.01)

(58) Field of Classification Search
CPC ... G09G 2300/0809; G09G 2320/0252; G09G 3/30–3291; G09G 3/32–329; G09G 3/22; G09G 3/34; G09G 2320/0247; G09G 2340/0435; G09G 2300/0842; G09G 2300/0861; G09G 2310/0251; H01L 27/00; H01L 27/02; H01L 27/1225
See application file for complete search history.

(56) References Cited

U.S. PATENT DOCUMENTS

| | | | | |
|---|---|---|---|---|
| 7,321,353 | B2 | 1/2008 | Tsuda et al. | |
| 7,724,218 | B2 | 5/2010 | Kim et al. | |
| 7,903,107 | B2 | 3/2011 | Ostlund | |
| 7,924,276 | B2 | 4/2011 | Tsuda et al. | |
| 8,578,192 | B2 | 11/2013 | Vasquez et al. | |
| 8,619,104 | B2 | 12/2013 | Umezaki et al. | |
| 8,860,639 | B2 | 10/2014 | Kim et al. | |
| 8,902,207 | B2 | 12/2014 | Ryu et al. | |
| 9,159,257 | B2 | 10/2015 | Kim et al. | |
| 9,548,031 | B2 | 1/2017 | Shin et al. | |
| 2010/0253666 | A1* | 10/2010 | Yamamoto | G09G 3/3233 345/211 |
| 2012/0105390 | A1* | 5/2012 | Kim | G09G 3/003 345/204 |
| 2012/0154262 | A1 | 6/2012 | Yamauchi | |
| 2013/0010015 | A1 | 1/2013 | Yamauchi | |
| 2013/0100173 | A1* | 4/2013 | Chaji | G09G 3/3275 345/690 |
| 2013/0265294 | A1* | 10/2013 | Kim | G09G 3/20 345/214 |
| 2014/0198114 | A1 | 7/2014 | Nambi et al. | |
| 2015/0109286 | A1 | 4/2015 | Verbeure et al. | |
| 2015/0154916 | A1 | 6/2015 | Chen et al. | |
| 2015/0243203 | A1* | 8/2015 | Kim | G09G 3/3233 345/212 |
| 2015/0243685 | A1 | 8/2015 | Lee et al. | |
| 2016/0196802 | A1* | 7/2016 | Nho | G09G 3/20 345/212 |
| 2016/0210900 | A1* | 7/2016 | Kim | G09G 3/3233 |
| 2016/0372040 | A1* | 12/2016 | Huangfu | G09G 3/3258 |

FOREIGN PATENT DOCUMENTS

| | | | |
|---|---|---|---|
| CN | 102013230 | A | 4/2011 |
| CN | 102467872 | A | 5/2012 |
| CN | 102498509 | A | 6/2012 |
| CN | 102542980 | A | 7/2012 |
| CN | 102763156 | A | 10/2012 |
| CN | 103597534 | A | 2/2014 |
| CN | 103606356 | A | 2/2014 |
| CN | 104751757 | A | 7/2015 |
| CN | 104867921 | A | 8/2015 |
| EP | 2911201 | A1 | 8/2015 |
| WO | 9409475 | A1 | 4/1994 |
| WO | 2014/110553 | A1 | 7/2014 |

OTHER PUBLICATIONS

International Search Report and Written Opinion for PCT Application No. PCT/US2016/048203 dated Nov. 2, 2016, 13 pgs.

* cited by examiner

DEVICE AND METHOD FOR EMISSION DRIVING OF A VARIABLE REFRESH RATE DISPLAY

CROSS REFERENCE TO RELATED APPLICATIONS

This application is a Non-Provisional Application of U.S. Provisional Patent Application No. 62/234,211, entitled "Device and Method for Improving LED Driving" filed Sep. 29, 2015, which is herein incorporated by reference.

BACKGROUND

The present disclosure relates generally to electronic displays and, more particularly, to devices and methods for achieving a reduction in visual artifacts related to reduced refresh rates of a light emitting diode (LED) electronic displays.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Flat panel displays, such as active matrix organic light emitting diode (AMOLED) displays, micro-LED (μLED) displays, and the like, are commonly used in a wide variety of electronic devices, including such consumer electronics as televisions, computers, and handheld devices (e.g., cellular telephones, audio and video players, gaming systems, and so forth). Such display panels typically provide a flat display in a relatively thin package that is suitable for use in a variety of electronic goods. In addition, such devices may use less power than comparable display technologies, making them suitable for use in battery-powered devices or in other contexts where it is desirable to minimize power usage.

LED displays typically include picture elements (e.g. pixels) arranged in a matrix to display an image that may be viewed by a user. Individual pixels of an LED display may generate light as a voltage is applied to each pixel. The voltage applied to a pixel of an LED display may be regulated by, for example, thin film transistors (TFTs). For example, a circuit switching TFT may be used to regulate current flowing into a storage capacitor, and a driving TFT may be used to regulate the voltage being provided to the LED of an individual pixel. Finally, the growing reliance on electronic devices having LED displays has generated interest in extending the life of the electronic display on a single charge without inducing visual disturbances on the display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relate to devices and methods for increasing power conservation for LED displays, such as AMOLED or μLED displays, while reducing potential visual artifacts that may accompany the increases in power conservation. For LED displays, emissive power is content dependent and not governed by backlight power—as in case of a Liquid Crystal Display (LCD). Therefore, for display applications including, but not limited to, watch screens having mostly black screens, emissive powering of the LEDs is minimal. Instead, panel driving power becomes more important.

Accordingly, one technique to reduce power consumption of an LED device may include reducing the panel refresh rate (e.g., the rate at which an array of display pixels in the display written to with image data) from, for example, 60 Hz to 30 Hz or less. This type of Variable Refresh rate (VRR) driving of the display can reduce the amount of power expended to drive the display; hence, enhancing battery life of a device significantly. However, utilizing VRR driving may also be accompanied by generation of visual artifacts that are displayed on the display. For example, one visual artifact that may be generated is flicker, which may be perceived because of brightness variation within the same frame for the same refresh rate of the display. Accordingly, the present disclosure includes devices and techniques that utilize VRR driving to decrease power consumption in an electronic device while simultaneously reducing visual artifacts generated on display that may otherwise be introduced due to the VRR driving of the display.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
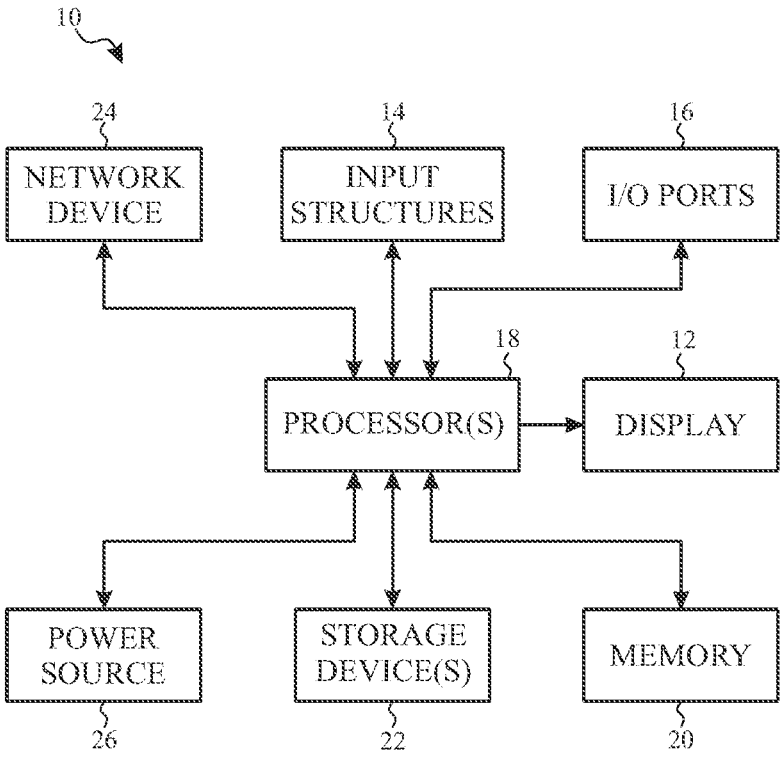
FIG. 1 is a block diagram of a electronic device with an electronic display, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As mentioned above, present embodiments relate to electronic displays, particularly to light emitting diode (LED) displays, such as active matrix organic light emitting diode (AMOLED) displays and micro-LED (μLED) displays. In particular, power consumption of LED displays can be reduced if the display refresh rate is reduced from, for example, 60 Hz to 30 Hz or even lower. This type of Variable Refresh rate (VRR) driving of the display can save, for example, almost 80% of driving power for the display at 1 Hz compared to that at 60 Hz, which can greatly help enhance the battery life of an electronic device having the display. Additionally, VRR driving might also obviate the need to apply black or display OFF to, for example, watch screens when not used actively.

However, use of VRR driving can be accompanied by visual artifacts. One such side effect is flicker, which can be perceived because of brightness variations on the display within the same frame for the same refresh rate. Sources of brightness variation may be addressed to reduce the generation of visual artifacts on the display. One such source of brightness variation is leakage of the voltage stored in the storage capacitor of a display pixel though the switch transistor. This brightness variation can be addressed by choosing low leakage switch transistors like the Oxide thin film transistors (TFT), for example, an Indium Gallium Zinc Oxide TFT, as well as utilizing a stack up structure which combines low temperature poly-silicon (LTPS) and Oxide TFTs to increase the efficacy of a display that is utilizing VRR driving. The combined TFT structure a LED display using both LTPS and Oxide TFTs may be referred to as a display pixel having an LTPO structure.

To ensure that LED emission follows the same ON/OFF response time and duration at low refresh rates as that at found at higher refresh rates, for example, 60 Hz, the emission control (EM) signal for the display pixel may be selectively pulsed at rates determined, for example, by a controller of the display. This pulsing of the EM signal may occur even as the display panel refresh (e.g., the data charging time to load a new image) is reduced at low refresh rates (e.g., less than 60 Hz).

Furthermore, the EM signal driving frequency can range across various frequencies. For example, the EM signal driving frequency can range from 60 Hz to higher values, for example, approximately 180 Hz, approximately 240 Hz, or higher levels. Additionally and/or alternatively, the width of the EM signals pulses can also be varied progressively, for example, within a frame using pulse width modulation (PWM) to further adjust the luminance of the display at varying refresh rates. It is also possible to use an additional switch TFT to discharge the LED and to regulate the discharge time thereof, which can allow for further regulation of the VRR index (e.g., an average luminance change of the display by 1% or less). The frequency of a discharge signal that can discharge the LED may be the same frequency as the EM signal or a factor of the EM signal.

To help illustrate, a computing device 10 that may utilize an electronic display 12 to display image frames is described in FIG. 1. As will be described in more detail below, the computing device 10 may be any suitable computing device, such as a handheld computing device, a tablet computing device, a notebook computer, and the like.

Accordingly, as depicted, the computing device 10 includes the electronic display 12, input structures 14, input/output (I/O) ports 16, one or more processor(s) 18, memory 20, a non-volatile storage device 22, a network interface 24, and a power source 26. The various components described in FIG. 1 may include hardware elements (e.g., circuitry), software elements (e.g., a tangible, non-transitory computer-readable medium storing industrious), or a combination of both hardware and software elements. It should be noted that FIG. 1 is merely one example of a particular implementation and is intended to illustrate the types of components that may be present in the computing device 10. Additionally, it should be noted that the various depicted components may be combined into fewer components or separated into additional components. For example, the memory 20 and the non-volatile storage device 22 may be included in a single component.

As depicted, the processor 18 is operably coupled with memory 20 and/or the non-volatile storage device 22. More specifically, the processor 18 may execute instruction stored in memory 20 and/or non-volatile storage device 22 to perform operations in the computing device 10, such as generating and/or transmitting image data to the electronic display 12. As such, the processor 18 may include one or more general purpose microprocessors, one or more application specific processors (ASICs), one or more field programmable logic arrays (FPGAs), or any combination thereof.

Additionally, the memory 20 and the non-volatile storage device 22 may be tangible, non-transitory, computer-readable mediums that store instructions executable by and data to be processed by the processor 18. For example, the memory 20 may include random access memory (RAM) and the non-volatile storage device 22 may include read only memory (ROM), rewritable flash memory, hard drives, optical discs, and the like. By way of example, a computer program product containing the instructions may include an operating system or an application program.

Furthermore, as depicted, the processor 18 is operably coupled with the network interface 24 to communicatively couple the computing device 10 to a network. For example, the network interface 24 may connect the computing device 10 to a personal area network (PAN), such as a Bluetooth network, a local area network (LAN), such as an 802.11x Wi-Fi network, and/or a wide area network (WAN), such as a 4G or LTE cellular network. Furthermore, as depicted, the processor 18 is operably coupled to the power source 26, which may provide power to the various components in the computing device 10, such as the electronic display 12. As such, the power source 26 may include any suitable source of energy, such as a rechargeable lithium polymer (Li-poly) battery and/or an alternating current (AC) power converter.

As depicted, the processor 18 is also operably coupled with I/O ports 16, which may allow the computing device 10 to interface with various other electronic devices, and input structures 14, which may allow a user to interact with the computing device 10. Accordingly, the inputs structures 14 may include buttons, keyboards, mice, trackpads, and the like. Additionally, the electronic display 12 may include touch components that facilitate user inputs by detecting occurrence and/or position of an object touching its screen (e.g., surface of the electronic display 12).

In addition to enabling user inputs, the electronic display 12 presents visual representations by displaying display image frames, such as a graphical user interface (GUI) for an operating system, an application interface, a still image, or video content. As depicted, the electronic display 12 is operably coupled to the processor 18. Accordingly, image frames displayed by the electronic display 12 may be based on image data received from the processor 18. As will be described in more detail below, in some embodiments, the electronic display 12 may display image frames by controlling supply current flowing into one or more display pixels.

Figure 2:
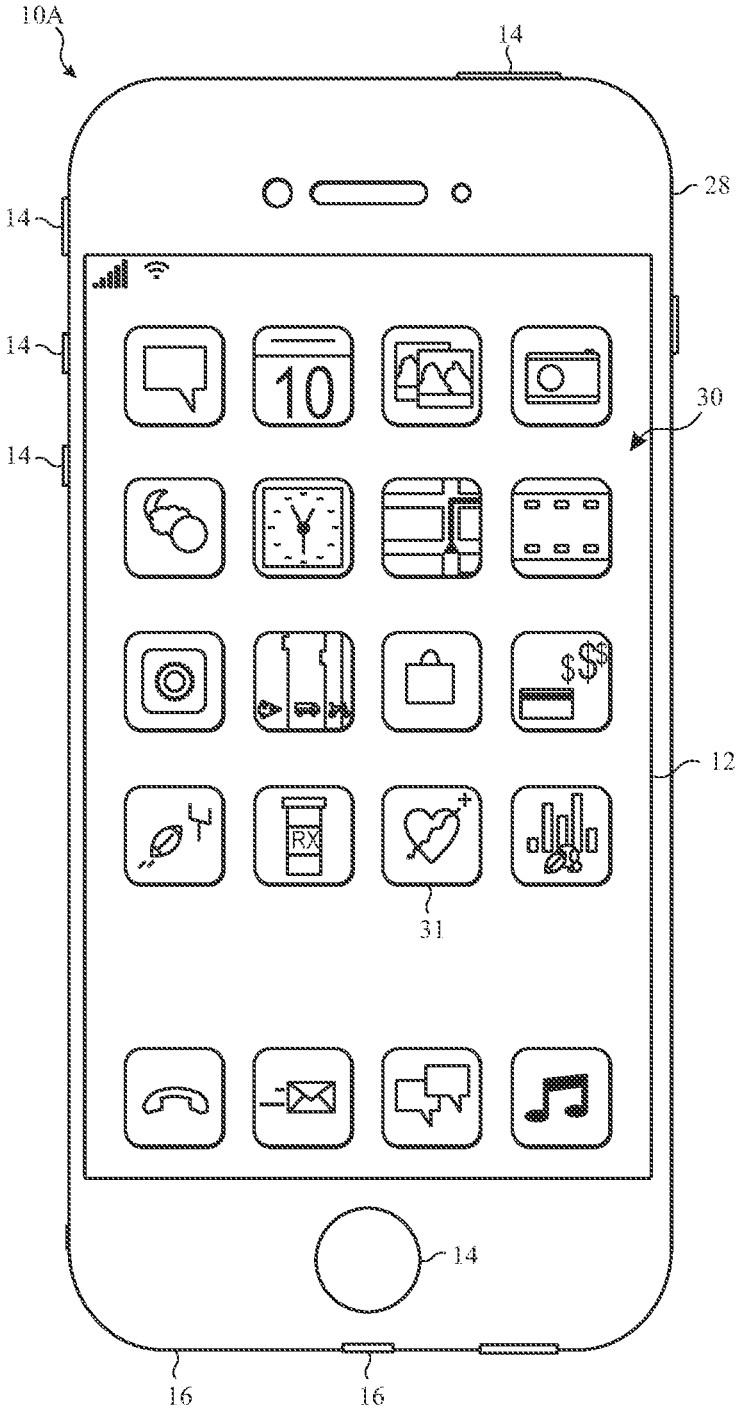
FIG. 2 is an example of the electronic device of FIG. 1, in accordance with an embodiment.

As described above, the computing device 10 may be any suitable electronic device. To help illustrate, one example of a handheld device 10A is described in FIG. 2, which may be a portable phone, a media player, a personal data organizer, a handheld game platform, or any combination of such devices. For example, the handheld device 10A may be a smart phone, such as any iPhone® model available from Apple Inc. As depicted, the handheld device 10A includes an enclosure 28, which may protect interior components from physical damage and to shield them from electromagnetic interference. The enclosure 28 may surround the electronic display 12, which, in the depicted embodiment, displays a graphical user interface (GUI) 30 having an array of icons 31. By way of example, when an icon 31 is selected either by an input structure 14 or a touch component of the electronic display 12, an application program may launch.

Additionally, as depicted, input structure 14 may open through the enclosure 28. As described above, the input structures 14 may allow a user to interact with the handheld device 10A. For example, the input structures 14 may activate or deactivate the handheld device 10A, navigate a user interface to a home screen, navigate a user interface to a user-configurable application screen, activate a voice-recognition feature, provide volume control, and toggle between vibrate and ring modes. Furthermore, as depicted, the I/O ports 16 open through the enclosure 28. In some embodiments, the I/O ports 16 may include, for example, an audio jack to connect to external devices.

Figure 3:
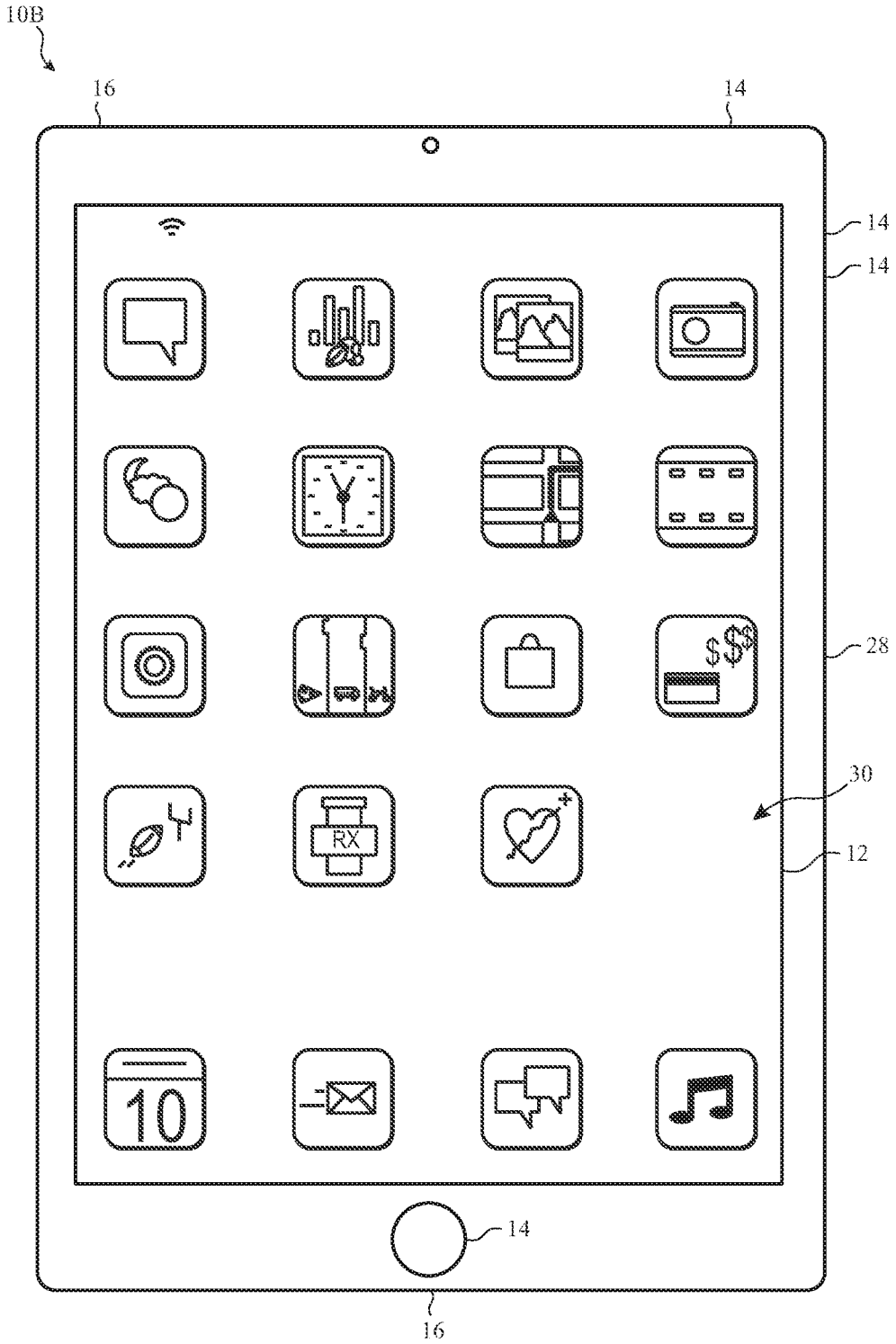
FIG. 3 is an example of the electronic device of FIG. 1, in accordance with an embodiment.
Figure 4:
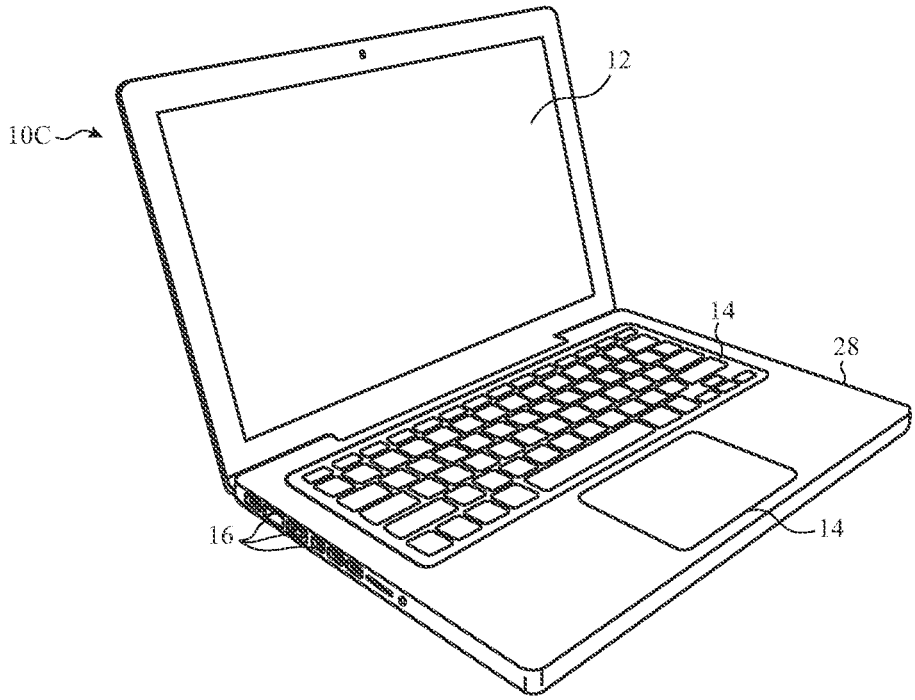
FIG. 4 is an example of the electronic device of FIG. 1, in accordance with an embodiment.
Figure 5:
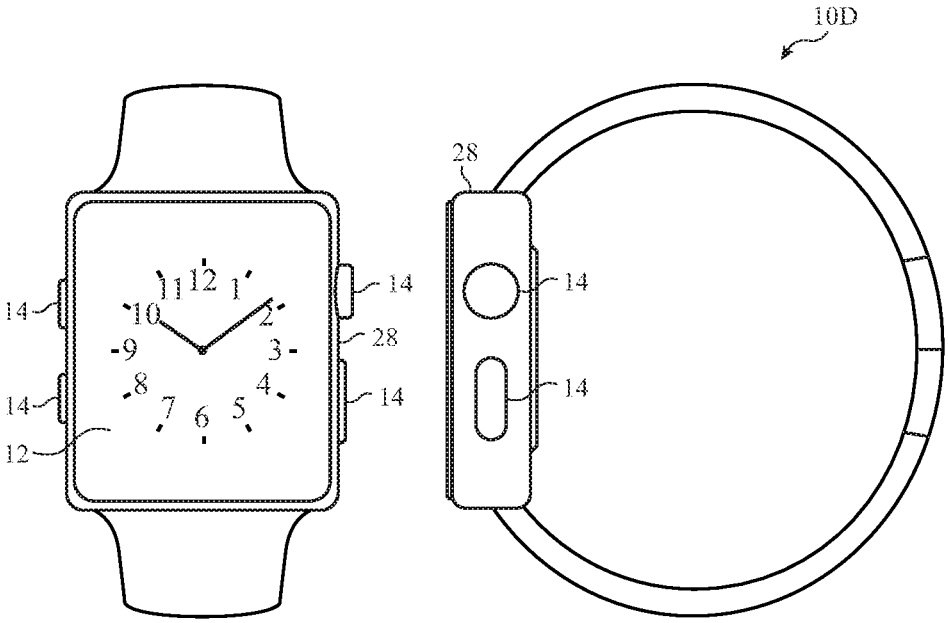
FIG. 5 is an example of the electronic device of FIG. 1, in accordance with an embodiment.

To further illustrate a suitable computing device 10, a tablet device 10B is described in FIG. 3, such as any iPad® model available from Apple Inc. Additionally, in other embodiments, the computing device 10 may take the form of a computer 10C as described in FIG. 4, such as any Macbook® or iMac® model available from Apple Inc. Furthermore, in other embodiments, the computing device 10 may take the form of a watch 10D as described in FIG. 5, such as an Apple Watch® model available from Apple Inc. As depicted, the tablet device 10B, the computer 10C, and the watch 10D may each also include an electronic display 12, input structures 14, I/O ports 16, an enclosure 28, or any combination thereof.

As described above, the computing device 10 may include an electronic display 12 to facilitate presenting visual representations to one or more users. Accordingly, the electronic display 12 may be any one of various suitable types. For example, in some embodiments, the electronic display 12 may be an LED display, such as an AMOLED display, a μLED, a PMOLED display, or the like. Although operation may vary, some operational principles of different types of electronic displays 12 may be similar. For example, electronic displays 12 may generally display image frames by controlling luminance of their display pixels based on received image data.

Figure 6:
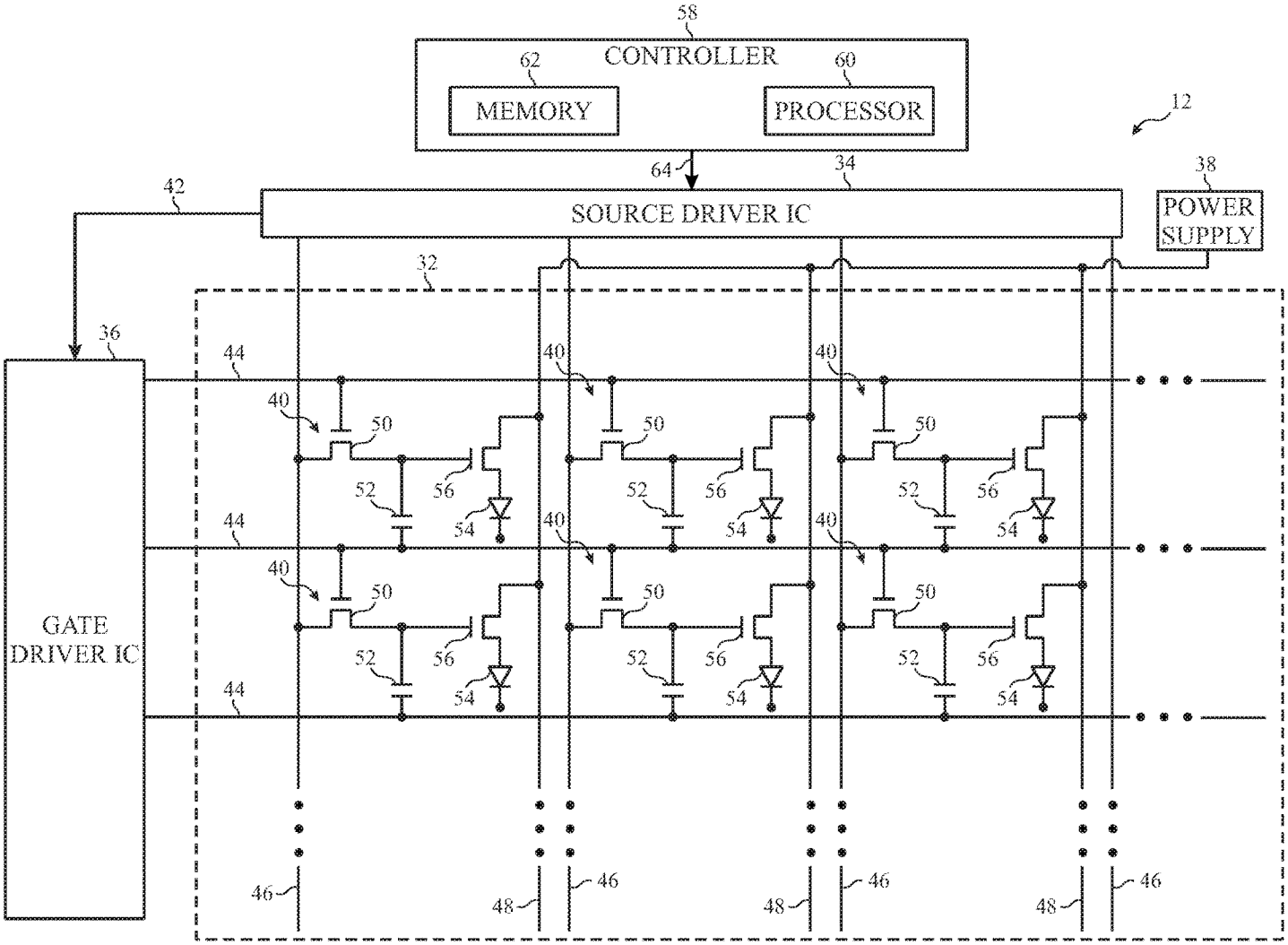
FIG. 6 is block diagram of an light emitting diode (LED) electronic display, in accordance with an embodiment.

To help illustrate, one embodiment of a display 12 is described in FIG. 6. As depicted, the display 12 includes a display panel 32, a source driver 34, a gate driver 36, and a power supply 38. Additionally, the display panel 32 may include multiple display pixels 40 arranged as an array or matrix defining multiple rows and columns. For example, the depicted embodiment includes a six display pixels 40. It should be appreciated that although only six display pixels 40 are depicted, in an actual implementation the display panel 32 may include hundreds or even thousands of display pixels 40.

As described above, display 12 may display image frames by controlling luminance of its display pixels 40 based at least in part on received image data. To facilitate displaying an image frame, a timing controller may determine and transmit timing data 42 to the gate driver based at least in part on the image data. For example, in the depicted embodiment, the timing controller may be included in the source driver 34. Accordingly, in such embodiments, the source driver 34 may receive image data that indicates desired luminance of one or more display pixels 40 for displaying the image frame, analyze the image data to determine the timing data 42 based at least in part on what display pixels 40 the image data corresponds to, and transmit the timing data 42 to the gate driver 36. Based at least in part on the timing data 42, the gate driver 36 may then transmit gate activation signals to activate a row of display pixels 40 via a gate line 44.

When activated, luminance of a display pixel 40 may be adjusted by image data received via data lines 46. In some embodiments, the source driver 34 may generate the image data by receiving the image data and voltage of the image data. The source driver 34 may then supply the image data to the activated display pixels 40. Thus, as depicted, each display pixel 40 may be located at an intersection of a gate line 44 (e.g., scan line) and a data line 46 (e.g., source line). Based on received image data, the display pixel 40 may adjust its luminance using electrical power supplied from the power supply 38 via power supply lines 48.

As depicted, each display pixel 40 includes a circuit switching thin-film transistor (TFT) 50, a storage capacitor 52, an LED 54, and a driving TFT 56 (whereby each of the storage capacitor 52 and the LED 54 are coupled to a common voltage, Vcom). However, variations of display pixel 40 may be utilized in place of display pixel 40 of FIG. 6. As will be discussed in greater detail below, display pixels 40 from FIGS. 7, 8, and 13 may be utilized in conjunction with the display panel 32 in place of the display pixels 40 of FIG. 6. Returning to the display pixel 40 of FIG. 6, to facilitate adjusting luminance, the driving TFT 56 and the circuit switching TFT 50 may each serve as a switching device that is controllably turned on and off by voltage applied to its respective gate. In the depicted embodiment, the gate of the circuit switching TFT 50 is electrically coupled to a gate line 44. Accordingly, when a gate activation signal received from its gate line 44 is above its threshold voltage, the circuit switching TFT 50 may turn on, thereby activating the display pixel 40 and charging the storage capacitor 52 with image data received at its data line 46.

Additionally, in the depicted embodiment, the gate of the driving TFT 56 is electrically coupled to the storage capacitor 52. As such, voltage of the storage capacitor 52 may control operation of the driving TFT 56. More specifically, in some embodiments, the driving TFT 56 may be operated in an active region to control magnitude of supply current flowing from the power supply line 48 through the LED 54. In other words, as gate voltage (e.g., storage capacitor 52 voltage) increases above its threshold voltage, the driving TFT 56 may increase the amount of its channel available to conduct electrical power, thereby increasing supply current flowing to the LED 54. On the other hand, as the gate voltage decreases while still being above its threshold voltage, the driving TFT 56 may decrease amount of its channel available to conduct electrical power, thereby decreasing supply current flowing to the LED 54. In this manner, the display 12 may control luminance of the display pixel 40. The display 12 may similarly control luminance of other display pixels 40 to display an image frame.

As described above, image data may include a voltage indicating desired luminance of one or more display pixels 40. Accordingly, operation of the one or more display pixels 40 to control luminance should be based at least in part on the image data. In the display 12, a driving TFT 56 may facilitate controlling luminance of a display pixel 40 by controlling magnitude of supply current flowing into its OLED 54. Additionally, the magnitude of supply current flowing into the OLED 54 may be controlled based at least in part on voltage supplied by a data line 46, which is used to charge the storage capacitor 52.

The display 12 of FIG. 6 also includes a controller 58. The source driver 34 may receive image data from an image source, such the controller 58, the processor 18, a graphics processing unit, a display pipeline, or the like. Additionally, the controller 58 may generally control operation of the source driver 34 and/or other portions of the electronic display 12. To facilitate control operation of the source driver 34 and/or other portions of the electronic display 12, the controller 58 may include a controller processor 60 and controller memory 62. More specifically, the controller processor 60 may execute instructions and/or process data stored in the controller memory 62 to control operation in the electronic display 12. Accordingly, in some embodiments, the controller processor 60 may be included in the processor 18 and/or in separate processing circuitry and the memory 62 may be included in memory 20 and/or in a separate tangible non-transitory computer-readable medium. Furthermore, in some embodiments, the controller 58 may be included in the source driver 34 (e.g., as a timing controller) or may be disposed as separate discrete circuitry internal to a common enclosure with the display 12 (or in a separate enclosure from the display 12). Additionally, the controller 58 may be a digital signal processor (DSP), an application-specific integrated circuit (ASIC), or an additional processing unit.

Furthermore, the controller processor 60 may interact with one or more tangible, non-transitory, machine-readable media (e.g., memory 62) that stores instructions executable by the controller to perform the method and actions described herein. By way of example, such machine-readable media can include RAM, ROM, EPROM, EEPROM, or any other medium which can be used to carry or store desired program code in the form of machine-executable instructions or data structures and which can be accessed by the controller processor 60 or by any processor, controller, ASIC, or other processing device of the controller 58.

The controller 58 may receive information related to the operation of the display 12 and may generate an output 64 that may be utilized to control operation of the display pixels 40. For example, the controller 58 may receive an indication of the refresh rate of the display 12 or may receive an indication of a desired refresh rate of the display 12 (e.g., the frequency at which data is written fully into the array of display pixels 40 of the display). This indication of the refresh rate of the display 12 or a desired refresh rate of the display 12 may part of a Variable Refresh rate (VRR) for the display 12 that indicates a reduction in the display 12 refresh rate from, for example, 60 Hz to 30 Hz or even lower frequencies. Accordingly, the controller 58 may alter its output 64 based on the indications of the VRR of the display 12. Similarly, the controller 58 may alter its output 64 based on the indications of a desired VRR for the display 12 (e.g., received from processor 18), for example, if the refresh rate of the display 12 is to be controlled by controller 58. The output 64 may be utilized to generate, for example, control signals in the source driver for control of the display pixels 40.

To produce output 64, the controller 58 may, for example, store the received indications of the desired VRR of the display 12 in the memory 62. The controller 58 may also determine the desired VRR of the display 12 (and/or the current VRR of the display 12) to calculate (determine) an emission control (EM) output as the output 64 to be utilized by the source driver 34 to generate a EM signal to be input to a display pixel 40 of the display. Alternatively, the controller 58 may generate the EM signal to be input to a display pixel 40 directly for transmission to a display pixel 40 via the source driver 34. This EM output may be determined and generated by the controller 58 to selectively minimize generation of artifacts related to the VRR of the display 12.

Figure 7:
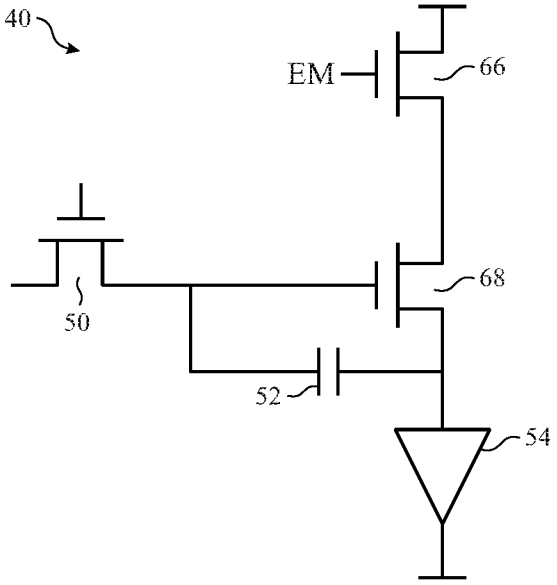
FIG. 7 is a block diagram of first embodiment of a display pixel for use with the LED electronic display of FIG. 6, in accordance with an embodiment.

FIG. 7 illustrates an embodiment of a display pixel 40 that may be controlled by the output 64 from controller 58 (either directly or via the source driver 34). Display pixel 40 of FIG. 7 includes the circuit switching TFT 50, which may be a low leakage switch transistor, such as an Oxide TFT (e.g., an Indium Gallium Zinc Oxide TFT), the storage capacitor 52, an LED 54, and a stacked structure of high mobility TFTs 66 and 68 (e.g., low temperature poly-silicon (LTPS) TFTs) as the driving TFTs for LED 54. The combination of the stacked high mobility TFTs 66 and 68 with an Oxide TFT 50 in FIG. 7 may be referred to as an LTPO structure that allows the display 12 utilizing the LTPO structure to increase its efficacy when utilizing VRR driving. Additionally, as illustrated, the high mobility TFT 66 (as an emission enable TFT) may receive the EM signal as a gate control signal, thus allowing for controller 58 to directly (or indirectly via the scan driver) control the emission of the display pixel 40.

Figure 8:
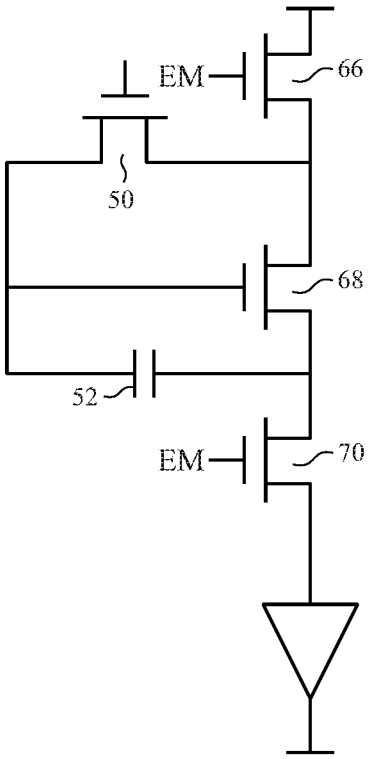
FIG. 8 is a block diagram of second embodiment of a display pixel for use with the LED electronic display of FIG. 6, in accordance with an embodiment.

Similarly, FIG. 8 illustrates a display pixel 40 that may be controlled by the output 64 from controller 58 (either directly or via the source driver 34). Display pixel 40 of FIG. 8 includes the circuit switching TFT 50, which may be a low leakage switch transistor, such as an Oxide TFT (e.g., an Indium Gallium Zinc Oxide TFT), the storage capacitor 52, an LED 54, and a stacked structure of high mobility TFTs 66, 68, and 70 (e.g., low temperature poly-silicon (LTPS) TFTs) as the driving TFTs for LED 54. The combination of the stacked high mobility TFTs 66, 68, and 70 with an Oxide TFT 50 in FIG. 8 may be also be referred to as an LTPO structure that allows the display 12 utilizing the LTPO structure to increase its efficacy when utilizing VRR driving. Additionally, as illustrated, one or more of the high mobility TFTs 66 and 70 (as emission enable TFTs) may receive the EM signal as a gate control signal, thus allowing for controller 58 to directly (or indirectly via the scan driver) control the emission of the display pixel 40.

Figure 9:
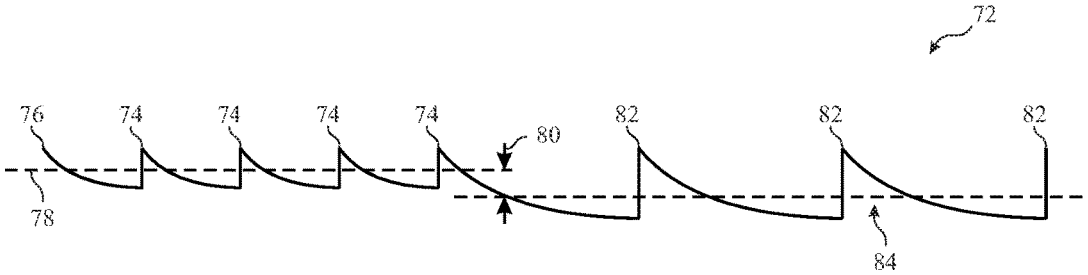
FIG. 9 is a graph illustrating changes in current in the LED electronic display of FIG. 6 utilizing a variable refresh rate, in accordance with an embodiment.

On occasion, as different refresh rates are generated for the display 12 via the VRR driving discussed above, changes in brightness of the display 12 may occur at transition points between the different refresh rates of the VRR. FIG. 9 illustrates a graph 72 illustrating changes in LED 54 current subsequent to a change in the refresh rate of a display 12 utilizing LTPS display pixels 40. As illustrated, the display 12 is refreshed over time at a first rate (e.g., 60 Hz), illustrated by points 74. The current 76 of the LED 54 dissipates (for example, due to capacitor 52 leakage) until another refresh of the display 12 at point 74, which leads to the illustrated average voltage 78 for LED 54 as the display 12 is being refreshed at the first rate. In conjunction with the VRR driving of the display 12, the refresh rate of the display 12 may be altered at point 80 such that the display 12 is refreshed over time at a second rate (e.g., 30 Hz), illustrated by points 82. The current 76 of the LED 54 dissipates (for example, due to capacitor 52 leakage) until another refresh of the display 12 at point 82, which leads to the illustrated average voltage 84 for LED 54 as the display 12 is being refreshed at the second rate. The change in the average voltage 78 to the average voltage 84 at point 80 may induce a visual artifact if the average luminance of the display exceeds 1%, which is referred to as the VRR index.

For an LTPO display 12, use of an Oxide TFT 50 may minimize the leakage of the voltage stored on the capacitor 52, minimizing the effects illustrated in FIG. 9, as application of a constant voltage on the capacitor 52 maintains constant current and constant instantaneous luminance of the LEDs 54 of the display 12 during the entire emission time of the frame. However, despite constant instantaneous luminance, the average luminance of the display 12 per frame can still vary for different refresh rates and degrade the VRR index for multiple reasons. For example, emission of the LEDs 54 may disabled for every row of display pixels 40 in the display 12 for one or more row times (which may be in the range of 30-40 μs for small sized displays 12) to initialize the LED 54 and program the display pixels 40 to appropriate grey levels. Accordingly, within a fixed time of 1 us, emission is disabled 60 times for a 60 Hz refresh rate of the display 12, but only once for 1 Hz refresh rate of the display 12 (i.e., disabling of the emission of an LED 54 via the EM signal is typically accomplished at a rate that matches the refresh rate of the display 12). Moreover, reduced instances of the disabling of the emission of an LED increases the average current per frame for lower refresh rates (e.g., 30 Hz, 1 Hz, etc.) relative to higher refresh rates (e.g., 60 Hz) This above discussed occurrence is illustrated in FIG. 10.

Figure 10:
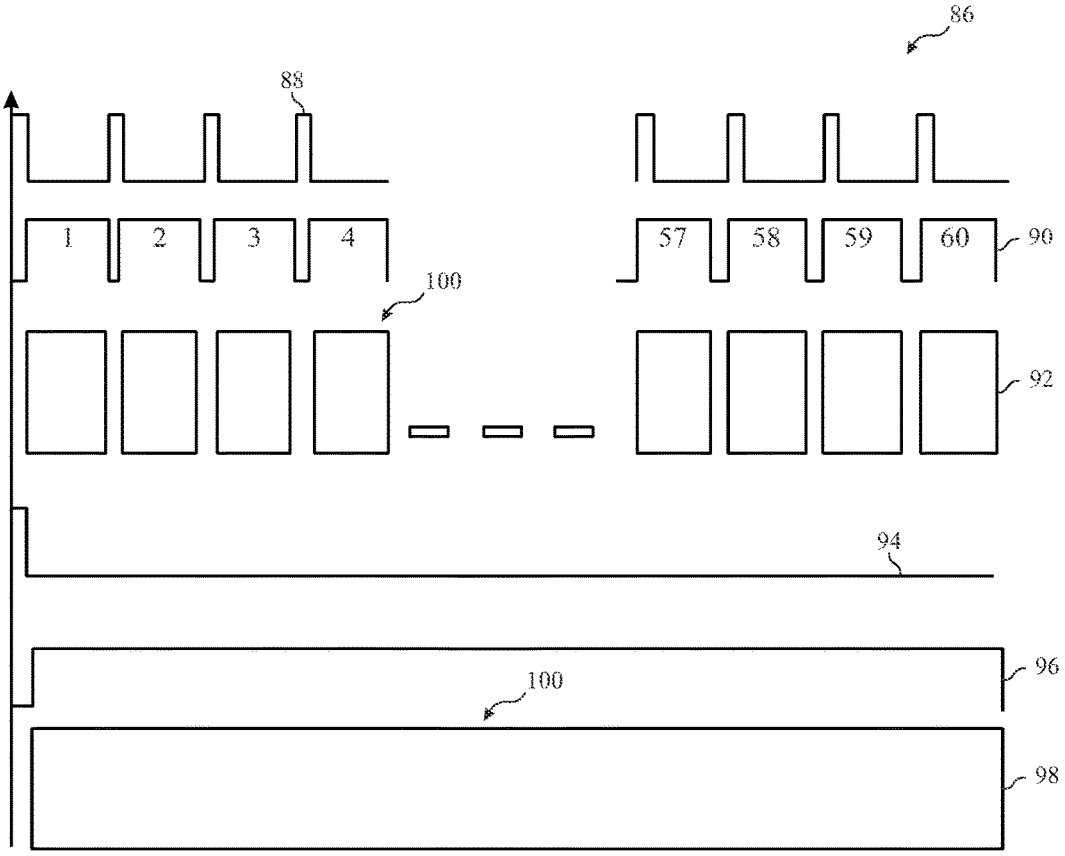
FIG. 10 is a timing diagram illustrating differences in luminance of the LED electronic display of FIG. 6 utilizing a variable refresh rate and display pixels of FIG. 7 or FIG. 8, in accordance with an embodiment.

FIG. 10 is a timing diagram illustrating differences in luminance of the display 12 utilizing VRR driving. As illustrated, when a display 12 utilizes a first refresh rate (e.g., 60 Hz), the data lines 46 may transmit scan signals 88 at the first refresh rate. Similarly, when the EM signal transmitted to the display pixels 40 matches the refresh rate of the display 12, the EM signal 90 pulses with the same frequency as the frequency of the scan signals 88. This leads to an LED current 92 being generated for an LTPO display 12.

Likewise, when the display 12 utilizes a second refresh rate (e.g., 1 Hz), the data lines 46 may transmit scan signals 94 at the second refresh rate. Similarly, when the EM signal transmitted to the display pixels 40 matches the refresh rate of the display 12, the EM signal 96 pulses with the same frequency as the frequency of the scan signals 94. This leads to an LED current 98 for an LTPO display being generated. Moreover, while the instantaneous luminance 100 generated by the LED current 92 and the LED current 98 are equivalent, because of the "zero" values in the LED current 92 that correspond to the troughs in the EM signal 90 pulses, the average luminance of the display when refreshed at the first refresh rate and the second refresh rate of FIG. 10 are not equivalent.

Additionally, despite constant instantaneous luminance, the average luminance of the display 12 per frame can vary due to delays caused between the activation of the emission TFTs 66 and/or 70 by the EM signal and the activation of the LED 54 (e.g., the LED 54 does not turn ON instantly). In addition to intended or parasitic capacitances at its anode terminal, the LED 54 has its own capacitance, which needs to be charged by the display pixel 40 current. Only when the anode voltage exceeds the turn ON voltage of the LED 54 may light emission begin. Additionally, for lower grey levels, the current is typically very small (e.g., in the range of pA), so the anode charging time and overall response time of the LED 54 may be in the milliseconds range. Furthermore, varying LED 54 response time behavior will influence average current per frame differently for varying grey levels, LED 54 stack up, temperature, etc. such that the luminance response time will be increased.

The controller 58 may be utilized to overcome the above noted potential issues that may cause the average luminance of the display 12 to vary per frame. For example as illustrated in the timing diagram 102 of FIG. 11, the controller 58 may issue an output 64 that selectively disassociates the frequency of the emission of the LED 54 from the refresh rate of the display 12, for example, through selecting particularly determined EM signals for transmission to the display pixels 40. As illustrated, when a display 12 utilizes a first refresh rate (e.g., 60 Hz), the data lines 46 may transmit scan signals 88 at the first refresh rate. Similarly, the controller 58 may cause the EM signal to be transmitted to the display pixels 40 at a rate that matches the refresh rate of the display 12, such that the EM signal 90 pulses with the same frequency as the frequency of the scan signals 88. This leads to an LED current 92 being generated for an LTPO display 12.

However, the controller 58 may also determine when the display 12 utilizes a second refresh rate (e.g., 1 Hz) as part of the VRR driving of the display 12, which will cause the data lines 46 to transmit scan signals 94 at the second refresh rate. When the display 12 utilizes the second refresh rate, the controller 58 may adjust the transmission of the EM signal such that the EM signal 104 pulses at a frequency that differs from the second refresh rate (e.g., with the same frequency as the frequency of the previous scan signals 88, i.e., at the first frequency). This leads to an LED current 106 being generated for the LTPO display 12 whereby both the instantaneous and the average luminance generated by the LED current 92 and the LED current 106 are equivalent, as illustrated in FIG. 11.

Thus, to ensure that the LED 54 emission, for example, follows the same ON/OFF response time and duration at low refresh rates (e.g., 1 Hz, 30 Hz, etc.) as that at found at higher refresh rates, (e.g., 60 Hz), the EM signal for the display pixels may be selectively pulsed by the controller 58 at determined rates. This pulsing of the EM signal may occur even as the display panel refresh (e.g., the data charging time to load a new image) is reduced at low refresh rates (e.g., less than 60 Hz). Moreover, as a majority of power consumption is related to the display 12 refresh and not the emission driving of the LED 54, the use of selectable EM signals by the controller 58 can provide constant average current during VRR driving, while preserving the power consumption benefits attributable to the VRR driving.

Figure 11:
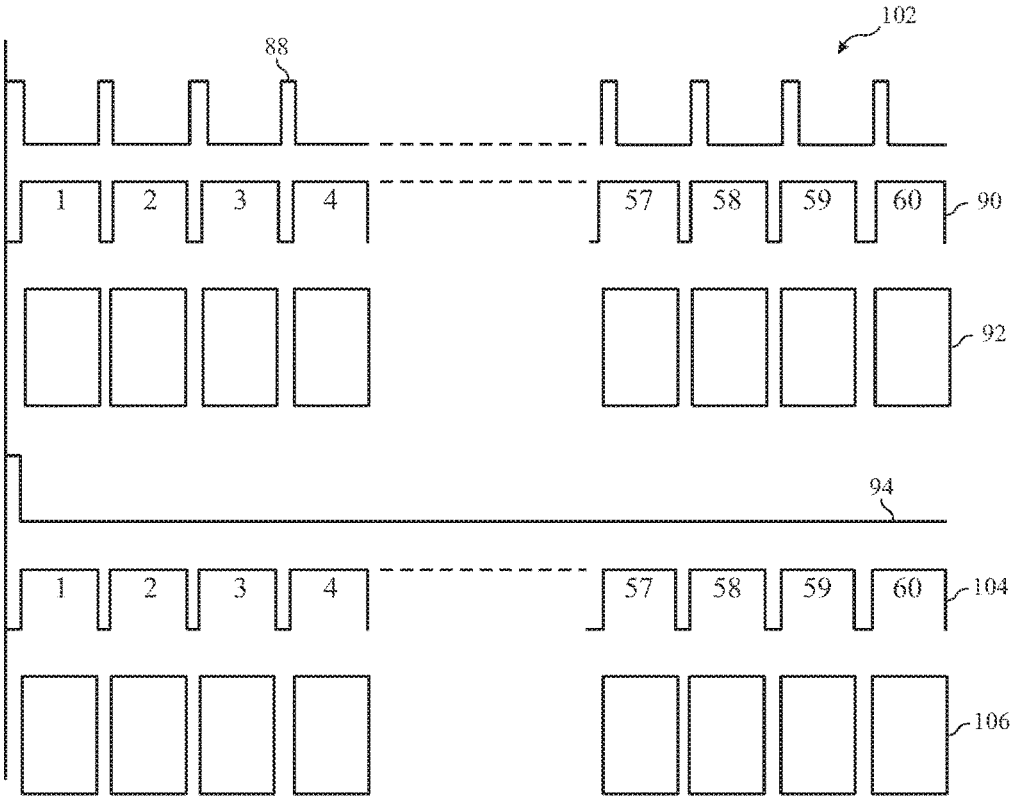
FIG. 11 is a second timing diagram illustrating a second set of signals generated in conjunction with the LED electronic display of FIG. 6 utilizing a variable refresh rate and display pixels of FIG. 7 or FIG. 8, in accordance with an embodiment.
Figure 12:
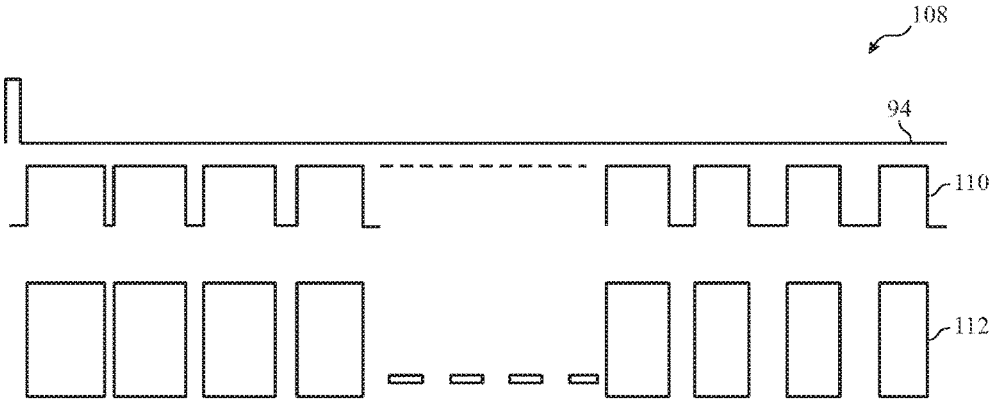
FIG. 12 is a third timing diagram illustrating a third set of signals generated in conjunction with the LED electronic display of FIG. 6 utilizing a variable refresh rate and display pixels of FIG. 7 or FIG. 8, in accordance with an embodiment.

Additionally, the controller 58 may cause the EM signals to vary from those illustrated in FIG. 11. The controller may cause the EM signals to pulse at frequencies greater than the refresh rate of the display 12, for example, at 120 Hz, 240 Hz, etc. Furthermore, the controller 58 may cause the EM signals to vary in pulse width from those illustrated in FIG. 11. For example, as illustrated in the timing diagram 108 of FIG. 12, the controller 58 may cause the width of the EM signals pulses 110 to be varied progressively, for example, within a frame using pulse width modulation (PWM) to further adjust the luminance generated from the LED current 112 for varying refresh rates of the display 12.

Figure 13:
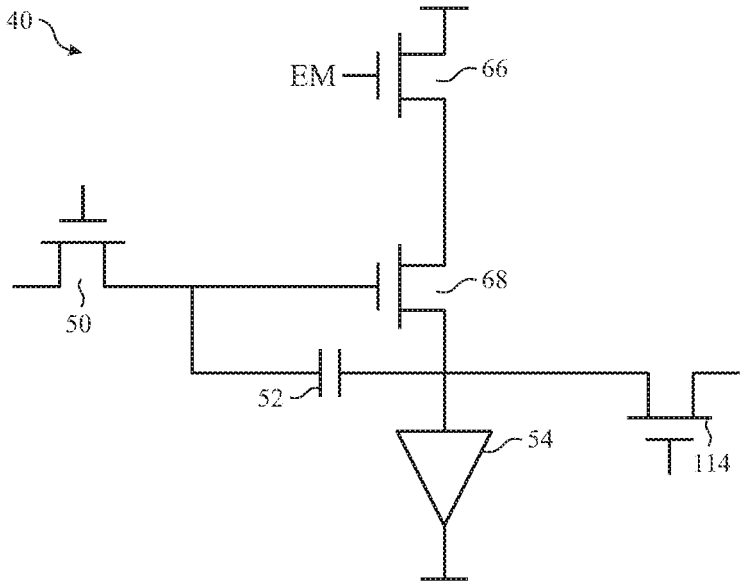
FIG. 13 is a block diagram of third embodiment of a display pixel for use with the LED electronic display of FIG. 6, in accordance with an embodiment.
Figure 14:
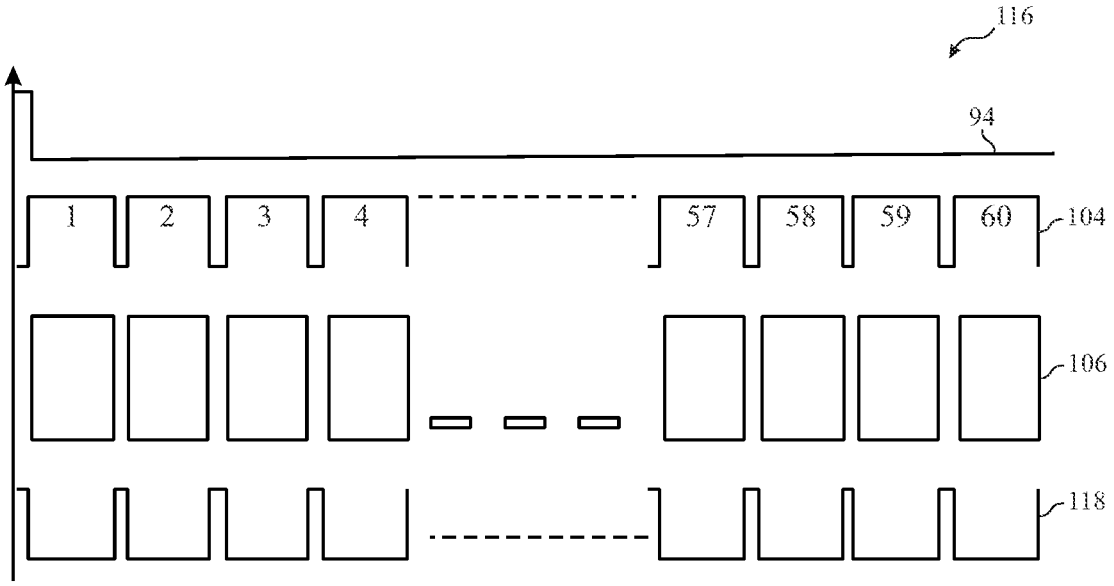
FIG. 14 is a fourth timing diagram illustrating a fourth set of signals generated in conjunction with the LED electronic display of FIG. 6 utilizing a variable refresh rate and display pixels of FIG. 13, in accordance with an embodiment.

Likewise, FIG. 13 illustrates display pixel 40 of FIG. 7 with an additional switch 114. Display pixel 40 of FIG. 13 may be utilized to further regulate the VRR index. For example, switch 114 may be utilized to discharge the LED 54 and to regulate the discharge time, which can allow for more particular regulation of the VRR index. Indeed, the controller 58 may generate a discharge signal as part of output 64 such that the discharge signal may be coupled to the gate of the switch 114 to control the activation of the switch 114. The frequency of the discharge signal may be selectable by the controller 58. For example, as illustrated in the timing diagram 116 of FIG. 14, the controller 58 may cause the discharge signal 118 to be pulsed at the same frequency as the EM signal 104. Similarly, the controller 58 may cause the discharge signal 118 to be pulsed at a different frequency as the EM signal 104, such as a factor (e.g., a multiple or a fraction) of the EM signal 104.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device, comprising:

a display; and a controller configured to:

determine a change in a refresh rate of the display from a first frequency to a second frequency, wherein the second frequency is lower than the first frequency; and in response to the determined change in refresh rate of the display from the first frequency to the second frequency, selectively generate a first control signal configured to control emission of a light emitting diode of a display pixel of the display at the first frequency.

2. The electronic device of claim 1, wherein the controller is configured to selectively generate the first control signal as comprising a variable width pulsed control signal.

3. The electronic device of claim 1, wherein the controller is configured to selectively generate a second control signal, wherein the second control signal is configured to activate a switch in the display pixel to discharge a light-emitting diode (LED) of the display pixel.

4. The electronic device of claim 3, wherein the controller is configured to selectively generate the second control signal having a common frequency with the first control signal.

5. The electronic device of claim 3, wherein the controller is configured to selectively generate the second control signal having a frequency multiple of a frequency of the first control signal.

6. The electronic device of claim 3, wherein the controller is configured to selectively generate the second control signal having a frequency less than a frequency of the first control signal.

7. The electronic device of claim 1, wherein the display comprises the display pixel, wherein the display pixel comprises a switch configured to be controlled by the first control signal.

8. The electronic device of claim 1, wherein the display comprises an active matrix organic light emitting diode (AMOLED) display.

9. A tangible, non-transitory computer-readable medium configured to store instructions executable by a processor of an electronic device, wherein the instructions comprise instructions to:

changing, via the processor, a refresh rate frequency of a display of the electronic device from a first frequency to a second frequency, wherein the second frequency is lower than the first frequency;

generating, via the processor, a control at the first frequency in response to changing the refresh rate frequency from the first frequency to the second frequency; and transmitting, from the processor, the control signal as a gate control signal of a first transistor of a display pixel of the display to control light emission from the display pixel.

10. The computer-readable medium of claim 9, comprising instructions to generate the control signal having a frequency identical to a previous refresh rate of the display.

11. The computer-readable medium of claim 10, comprising instructions to selectively generate and transmit a scan signal at the refresh rate frequency to a second transistor of the display pixel.

12. A display, comprising:

a display pixel; and a controller, wherein the controller is configured to transmit a scan signal to control a refresh rate of the display pixel from a first frequency to a second frequency, wherein in response to a change of the refresh rate from the first frequency to the second frequency, an emission signal is maintained at the first frequency to control emission of light from the display pixel while the scan signal is changed from the first frequency to the second frequency.

13. The display of claim 12, wherein the controller is configured to transmit the emission signal at the first frequency matching a previous frequency of the scan signal.

14. The display of claim 12, wherein the controller is configured to generate the emission signal based on an emission control output generated by a second controller coupled to the controller.

15. The display of claim 12, wherein the display pixel comprises a low leakage switch transistor.

16. The display of claim 15, wherein the display pixel comprises a stacked structure of high mobility thin film transistors.

17. The display of claim 16, wherein the display pixel comprises a light emitting diode and a switch configured to discharge the light emitting diode and to regulate a discharge time of the light emitting diode.

18. A controller configured to:

receive an indication of a change in a refresh rate frequency of a display from a first frequency to a second frequency, wherein the second frequency is less than the first frequency;

in response to the indication of the change in the refresh rate frequency from the first frequency to the second frequency, generate a first control signal configured to control emission of light from a display pixel of the display based on the first frequency, wherein a frequency of the first control signal is at the first frequency; and generate a second control signal configured to control a refresh rate of the display pixel at the second frequency.

19. The controller of claim 18, wherein the controller is configured to transmit the first control signal to a scan driver to cause the scan driver to generate an emission signal at the first frequency for transmission to the display to control the emission of light from the display pixel.

20. The controller of claim 18, wherein the controller is configured to transmit the second control signal to a scan driver to cause the scan driver to generate a scan signal at the second frequency for transmission to the display to control the refresh rate of the display pixel.

21. A method, comprising:

receiving an indication of a change in a refresh rate frequency of a display from a first frequency to a second frequency, wherein the second frequency is less than the first frequency; and in response to the indication of the change in the refresh rate frequency from the first frequency to the second frequency, generating a control signal configured to control emission of light from a display pixel of the display based on the first frequency, wherein a frequency of the control signal is at the first frequency and comprises a first signal pulse and a second signal pulse, and wherein a first width of the first signal pulse is greater than a second width of the second signal pulse.

* * * * *